US011691842B2

(12) United States Patent
Eoka et al.

(10) Patent No.: US 11,691,842 B2
(45) Date of Patent: Jul. 4, 2023

(54) IMAGE FORMING APPARATUS

(71) Applicant: TOSHIBA TEC KABUSHIKI KAISHA, Tokyo (JP)

(72) Inventors: Kenji Eoka, Singapore (SG); Akira Suzuki, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/517,695

(22) Filed: Nov. 3, 2021

(65) Prior Publication Data

US 2022/0055854 A1 Feb. 24, 2022

Related U.S. Application Data

(63) Continuation of application No. 16/416,302, filed on May 20, 2019, now abandoned.

(30) Foreign Application Priority Data

May 25, 2018 (JP) ..... JP2018-100200

(51) Int. Cl.
*G07D 11/00* (2019.01)
*B65H 29/14* (2006.01)
(Continued)

(52) U.S. Cl.
CPC ..... *B65H 43/00* (2013.01); *B65H 29/14* (2013.01); *G07D 11/17* (2019.01); *G07F 19/203* (2013.01);
(Continued)

(58) Field of Classification Search
CPC ..... B65H 26/02; B65H 2553/61; B65H 2553/612; B65H 2511/528;
(Continued)

(56) References Cited

U.S. PATENT DOCUMENTS 5,615,876 A * 4/1997 Yergenson ..... B65H 7/06 399/21
7,322,760 B2 1/2008 Campanini
(Continued)

FOREIGN PATENT DOCUMENTS

EP 2980000 B1 4/2017
JP 2009-292622 12/2009
JP 2018196921 A * 12/2018

OTHER PUBLICATIONS

Japanese Office Action for Japanese Patent Application No. 2018-100200 dated Nov. 11, 2021.
(Continued)

*Primary Examiner* — Luis A Gonzalez
(74) *Attorney, Agent, or Firm* — Amin, Turocy & Watson, LLP

(57) ABSTRACT

In accordance with an embodiment, an image forming apparatus comprises an image forming section configured to form an image on a sheet; a sheet discharge port through which the sheet is discharged; a sheet conveyance roller configured to convey the sheet to the sheet discharge port; a movable sheet guide, arranged in such a manner that an imaginary line connecting a portion contacting the sheet of the sheet conveyance roller with the sheet discharge port passes through a cross-sectional area, configured to be capable of moving in a direction away from a surface of the sheet; and a guide sensor configured to detect movement of the movable sheet guide.

18 Claims, 8 Drawing Sheets

(51) Int. Cl.

| | |
|---|---|
| ***B65H 26/02*** | (2006.01) |
| ***B65H 29/52*** | (2006.01) |
| ***B65H 43/00*** | (2006.01) |
| ***G07F 19/00*** | (2006.01) |
| ***G07D 11/17*** | (2019.01) |

(52) U.S. Cl.
CPC .... *G07F 19/209* (2013.01); *B65H 2404/7414* (2013.01); *B65H 2701/1912* (2013.01)

(58) Field of Classification Search
CPC ..... B65H 2601/255; B65H 29/52; B65H 2301/44342; B65H 43/00; B65H 43/04; B65H 29/14; B65H 2404/414; B65H 2701/1912; B41J 11/70; G07F 19/203; G07F 19/209; G07D 11/17
See application file for complete search history.

(56) References Cited

U.S. PATENT DOCUMENTS

| | | | | |
|---|---|---|---|---|
| 3,070,371 | A1 | 12/2011 | Campanini | |
| 9,440,469 | B2 | 9/2016 | Zhang et al. | |
| 2009/0035044 | A1 | 2/2009 | Yoshioka | |
| 2014/0197268 | A1 | 7/2014 | Zhang et al. | |
| 2015/0001780 | A1* | 1/2015 | Kasuga ..... | B41J 11/70 270/1.02 |
| 2016/0355035 | A1 | 12/2016 | Campanini | |
| 2017/0253057 | A1 | 9/2017 | Zhang et al. | |
| 2017/0362045 | A1 | 12/2017 | Masuda | |

OTHER PUBLICATIONS

Non-Final Office Action for U.S. Appl. No. 16/416,302 dated Jan. 27, 2021.
Final Office Action for U.S. Appl. No. 16/416,302 dated Aug. 3, 2021.
U.S. Appl. No. 16/416,302, filed May 20, 2019.

* cited by examiner (a)

(b)

IMAGE FORMING APPARATUS

CROSS-REFERENCE TO RELATED APPLICATIONS

This application is a Continuation of application Ser. No. 16/416,302 filed on May 20, 2019, the entire contents of which are incorporated herein by reference.

This application is based upon and claims the benefit of priority from Japanese Patent Application No. 2018-100200, filed on May 25, 2018, the entire contents of which are incorporated herein by reference.

FIELD

Embodiments described herein relate generally to an image forming apparatus and methods related thereto.

BACKGROUND

An ATM (Automatic Teller Machine) is an automatic transaction apparatus operated by a customer to perform transaction such as cash accounting. The ATM includes a printer that issues a receipt on which transaction details are recorded. The printer prints the transaction details on the sheet while conveying the sheet, which is a print medium, towards the discharge port. A discharge port of the sheet is located on a front surface side of the ATM. The customer receives a receipt discharged from the discharge port.

However, a customer may touch the receipt before printing is finished, and as a result, the sheet may not be normally discharged. For example, if the customer pulls out the sheet with hand, printing disorder may occur. Alternatively, if the discharge of the sheet from the discharge port is hindered by the hand touching the sheet, a sheet jam may occur at the inner side of the discharge port.

DETAILED DESCRIPTION

Figure 1:
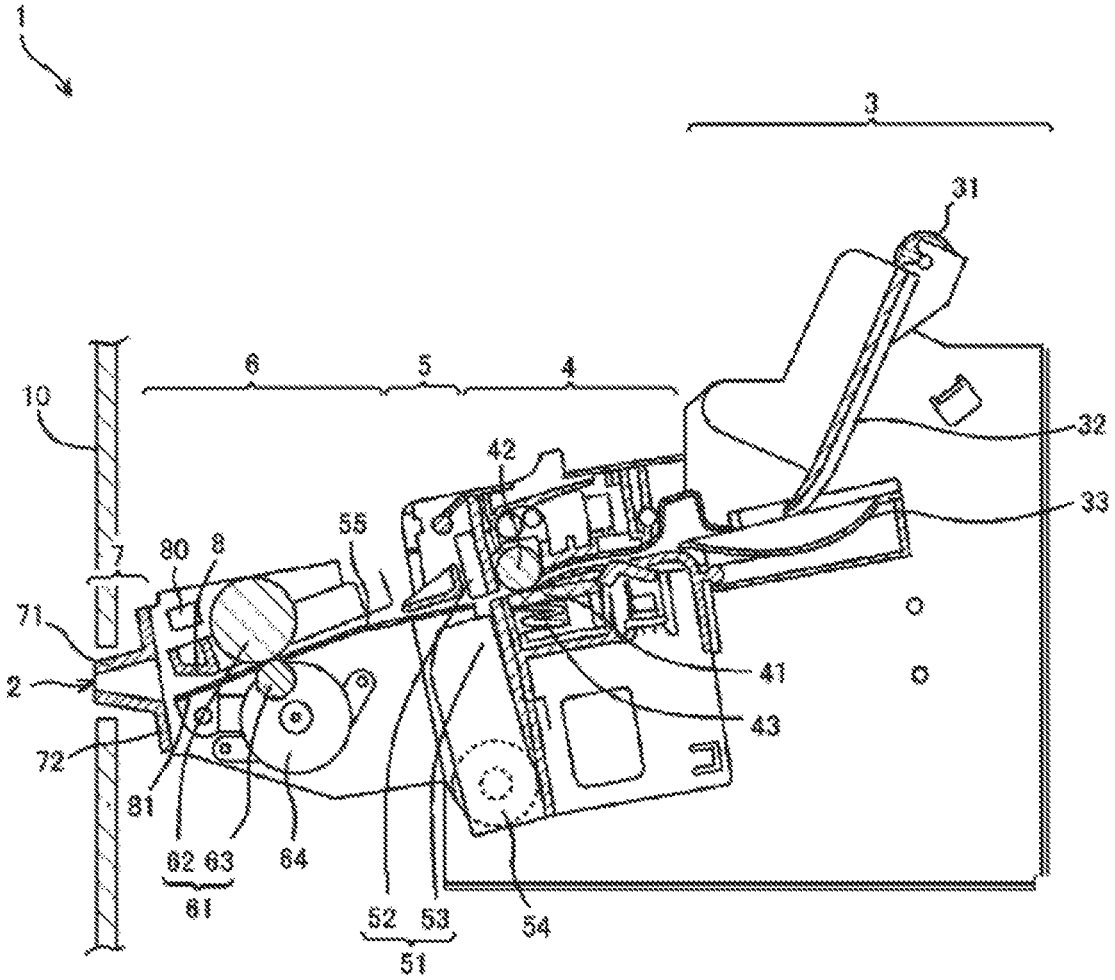
FIG. 1 is a longitudinal sectional view of a printer according to an embodiment.

In accordance with an embodiment, an image forming apparatus comprises an image forming section configured to form an image on a sheet; a sheet discharge port through which the sheet is discharged; a sheet conveyance roller configured to convey the sheet to the sheet discharge port; a movable sheet guide, arranged in such a manner that an imaginary line connecting a portion contacting the sheet of the sheet conveyance roller with the sheet discharge port passes through a cross-sectional area, configured to be capable of moving in a direction away from a surface of the sheet; and a guide sensor configured to detect movement of the movable sheet guide.

Hereinafter, a printer mounted in an ATM is described in detail as an example of an image forming apparatus according to an embodiment with reference to the accompanying drawings. In each drawing, the same components are denoted with the same reference numerals.

Figure 2:
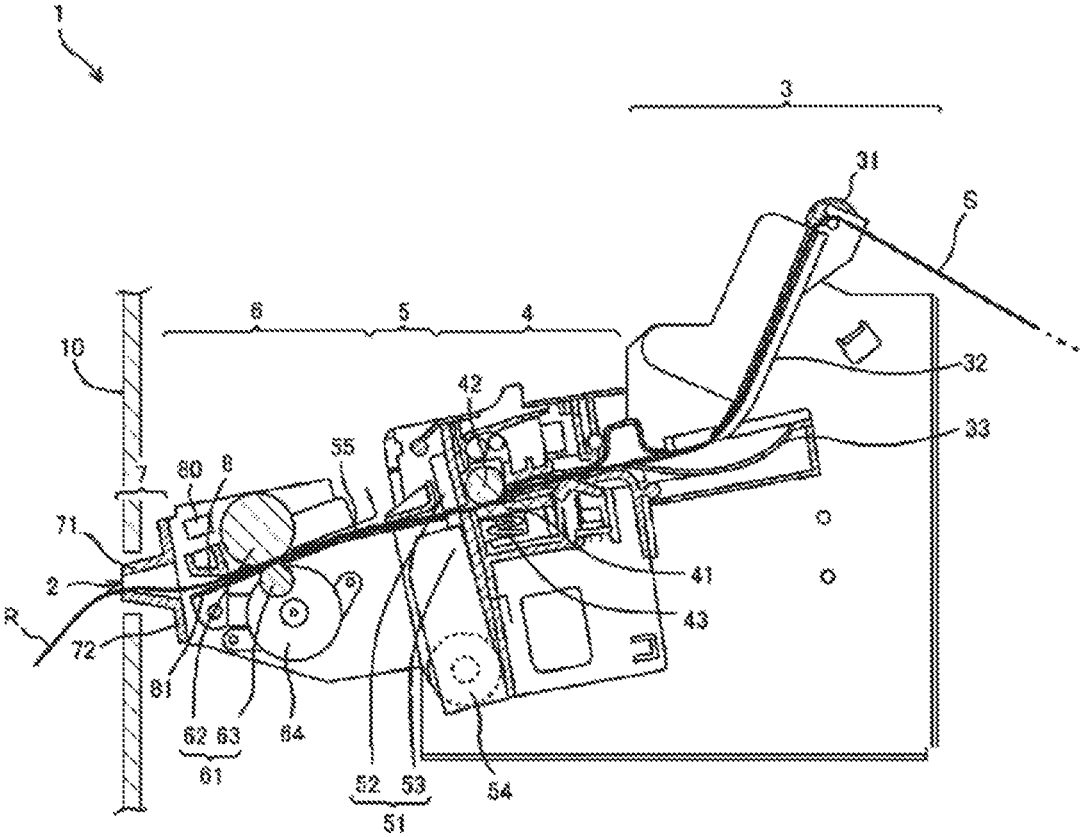
FIG. 2 is a longitudinal sectional illustrating movement of a sheet in the printer according to the embodiment.

FIG. 1 is a longitudinal sectional view of a printer 1 viewed from a side surface side. FIG. 2 is a diagram for showing a sheet S which is a print medium in the longitudinal sectional view of the printer 1. The printer 1 is mounted at the inner side of a front panel 10 of the ATM. The printer 1 creates a receipt R by printing details of a transaction made by a customer through operation on the ATM on the sheet S. The receipt R is discharged from a discharge port 2, which is a sheet discharge port arranged at an opening of the front panel 10 of the ATM. The height at which the discharge port 2 is set to a height within a range in which the customer can easily take the receipt R by hand, for example, from the height of waist to the height of shoulders of a general adult.

The printer 1 is a thermal printer that prints an image on a sheet S which is the print medium under the action of heat. A printing system thereof may be either a heat sensitive system or a thermal transfer system. In the case of the heat sensitive system, a thermal sheet is used as the sheet S which is the print medium, and in the case of the thermal transfer system, an ink ribbon is used.

The printer 1 includes a sheet supply section 3, a printing section 4 for printing an image such as transaction details on the sheet S, a cutting section 5 for cutting the sheet S on which the image is printed, a sheet conveyance section 6 for conveying the sheet S towards the discharge port 2, and a discharge section 7 for discharging the sheet S from the printer 1 as the receipt R. The sheet S passes the sheet supply section 3, the printing section 4, the cutting section 5 and the sheet conveyance section 6 in this order, and is then discharged from the discharge port 2 at the tip of the discharge section 7. The sheet supply section 3 includes a guide roller 31 for applying tension to the sheet S, and guides 32 and 33 for guiding the sheet S to the printing section 4. A base end side of the sheet S is wound in a roll and stored in a hopper (not shown). The sheet S is replenished by storing the roll of a new sheet S in the hopper and guiding the tip of the sheet S pulled out of the roll to the printing section 4 via the guide roller 31 and the guides 32 and 33.

The printing section 4 is an example of an image forming section that forms an image on the sheet S. The printing section 4 includes a thermal head 41 as a print head (image forming head) and a platen roller 42. In the thermal head 41, heat generation elements for forming dots are formed, for example, in a line. The thermal head 41 is arranged in such a manner that a portion where the heat generation elements are arranged faces the platen roller 42 across the sheet S, and is biased towards the platen roller 42 by a biasing device 43 such as a spring.

In the platen roller 42, a portion in contact with the sheet S is formed of resin such as rubber. The platen roller 42 is connected to a motor 44 which is an example of a drive device via a power transmission device such as a gear or a rotation belt, for example (not shown in FIG. 1 and FIG. 2; refer to FIG. 5). The motor 44 is, for example, a stepping motor. The platen roller 42 is rotated by a driving force from the motor 44. The thermal head 41 and the platen roller 42 synchronize a printing operation and a conveyance operation to perform printing on the sheet S while conveying the sheet S.

The cutting section 5 includes a cutter 51. The cutter 51 includes a fixed cutter 52 and a movable cutter 53. A blade of the movable cutter 53 moves forward and backward with respect to a blade of the fixed cutter 52 by a driving force from a motor 54 which is an example of the drive device. The cutter 51 moves the blade of the movable cutter 53 forward and backward to cut the rear end of the printed sheet S. The cutter 51 may be either a cutter of a full cutting system for completely cutting the sheet S or a cutter of a partial cutting system for partially cutting the sheet S. In the case of the partial cutting system, the customer finally cuts out the remaining uncut part. The customer cuts out the sheet S by pulling the sheet S forward or cuts out the sheet S using an edge of the discharge port 2 by pulling the sheet S diagonally. Furthermore, the cutter 51 which is an automatic cutter may be omitted and a manual cutter may be provided. A lower edge of the discharge port 2 is formed in a jagged shape as the manual cutter, and the customer cuts out the sheet S using the jag.

The sheet conveyance section 6 includes, for example, a conveyance roller 61 as a sheet conveyance roller. The conveyance roller 61 includes a drive roller 62 and a driven roller 63 vertically arranged so as to contact each other. The drive roller 62 and the driven roller 63 rotate to sandwich the sheet S to convey the sheet S. The sheet S is guided from the cutting section 5 to the sheet conveyance section 6 by a fixed sheet guide 55. The drive roller 62 is connected to a motor 64 which is an example of the drive device via a power transmission device (not shown) such as a gear or a rotation belt, for example. The motor 64 is, for example, a stepping motor. The drive roller 62 is rotated by a driving force from the motor 64. The driven roller 63 is driven under the action of friction generated by the rotation of the drive roller 62. The drive roller 62 rotates in synchronization with the conveyance of the sheet S by the platen roller 42.

A movable sheet guide 8 and a fixed sheet guide 81 are arranged between the discharge port 2 and a place where the conveyance roller 61 and the sheet S contact each other, i.e., a position where the drive roller 62 and the driven roller 63 sandwich the sheet S. A space between the movable sheet guide 8 arranged on the upper side and the fixed sheet guide 81 arranged on the lower side forms a conveyance path of the sheet S towards the discharge section 7. The fixed sheet guide 81 supports the sheet S conveyed in a sandwiched manner by the drive roller 62 and the driven roller 63 on an upper surface thereof and guides the sheet S towards the discharge section 7. A distance from a position where the drive roller 62 and the driven roller 63 sandwich the sheet S to the discharge port 2 is, for example, 10 mm to 20 mm. The movable sheet guide 8 functions as a sensor for detecting a discharge abnormality caused by the customer pulling the sheet S (receipt R) during printing and a discharge abnormality that the sheet S is jammed at the inner side of the discharge port 2. A guide sensor 80 detects the position of the movable sheet guide 8.

Figure 3:
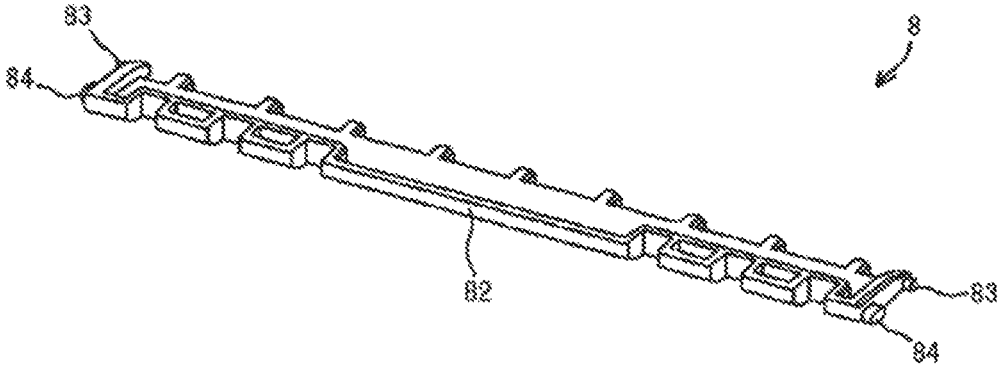
FIG. 3 is a perspective view illustrating a movable sheet guide of the printer according to the embodiment.

The movable sheet guide 8 has an elongated shape as shown in FIG. 3. The movable sheet guide 8 extends along a width direction of the sheet S. The length of the movable sheet guide 8 is set to be longer than a sheet width. The sheet width is, for example, 50 mm to 80 mm. The movable sheet guide 8 has, for example, a slit shape in which unevenness is formed on a front surface side thereof so that a contact area when contacting the sheet S becomes small. For example, a standing wall 82 is formed along an edge of the unevenness on the front surface side to increase strength to suppress bending. The material of the movable sheet guide 8 is, for example, a resin material such as plastic.

Figure 4:
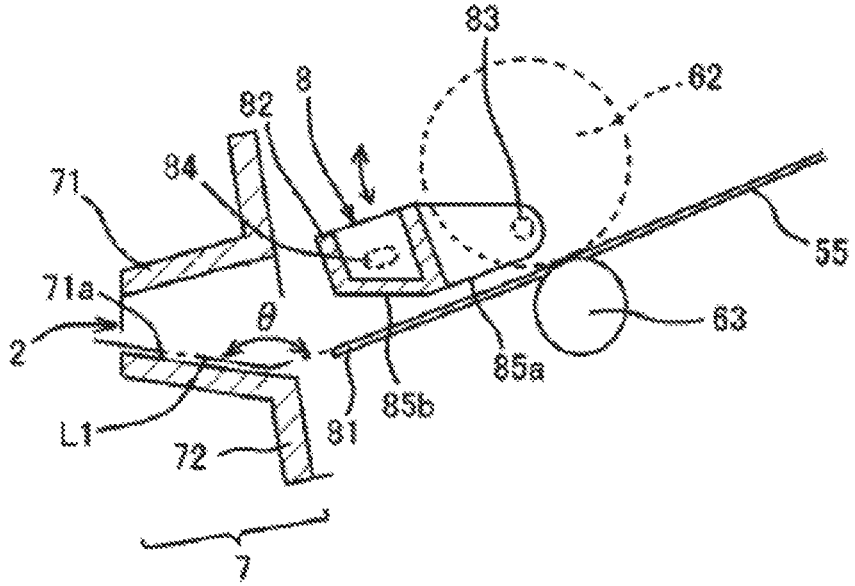
FIG. 4 is a diagram illustrating a positional relationship between the movable sheet guide and a discharge section.
Figure 4:
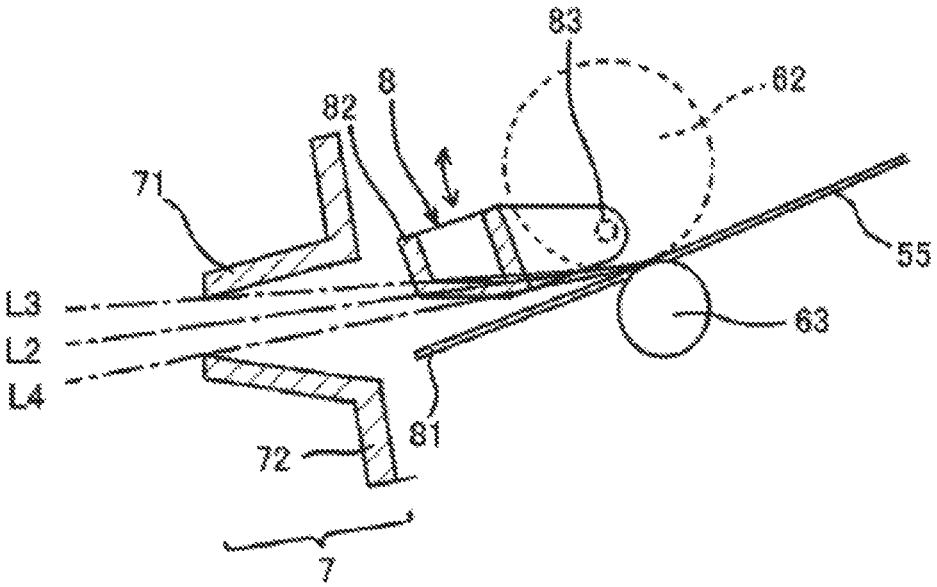

A cylindrical rotation axis 83 and an oval stopper 84 of the movable sheet guide 8 are respectively formed on the side surfaces of both ends thereof. The cylindrical rotation axis 83 is fitted to, for example, a cylindrical support member (not shown) provided on a printer main body side. The movable sheet guide 8 is rotatable in a circumferential direction (a direction indicated by an arrow) around the rotation axis 83, as shown in FIG. 4. The stopper 84 is supported by a support member (not shown) provided on the printer main body side below the stopper 84. The stopper 84 prevents the movable sheet guide 8 from rotating further downward. Specifically, when the stopper 84 is supported by the support member (not shown), the movable sheet guide 8 is in a home position.

The home position of the movable sheet guide 8 is set to a position far away from the upper surface of the sheet S. Alternatively, the home position may be in contact with the upper surface of the sheet S. The movable sheet guide 8 is arranged in such a manner that a bottom surface 85*a* on the rear side is parallel to, for example, an upper surface of the fixed sheet guide 81 located below. A bottom surface 85*b* on the front side is inclined in a direction away from the fixed sheet guide 81. The bottom surface 85*b* on the front side is formed to extend, for example, in a horizontal direction. Of course, shapes and angles of the bottom surfaces 85*a* and 85*b* are not limited.

The discharge section 7 includes a tapered discharge guide 71. The opening at the tip of the discharge guide 71 is the discharge port 2 and is a rectangular opening when viewed from the front surface side (customer side) of the ATM. Any size of the rectangular discharge port 2 can be used as long as it is larger than the cross section of the sheet S, and for example, the width thereof is 50 mm to 80 mm and the height thereof is 5 mm to 10 mm. The discharge guide 71 is integrally formed with the vertically inclined plate 72. In the discharge section 7, both ends of the inclined plate 72 are fixed to the printer main body. The discharge guide 71 and the inclined plate 72 each are made of, for example, a resin material such as plastic.

The fixed sheet guide 81 extends to the vicinity of the vertically inclined plate 72 of the discharge section 7. As shown in FIG. 4(*a*), an imaginary line L1 connecting an extension line of the upper surface of the fixed sheet guide 81 and an upper surface 71*a* of the discharge guide 71 has V shape having an angle θ. The angle θ is not limited but is preferably obtuse. Specifically, the conveyance path of the sheet S defined by the fixed sheet guide 81 and the discharge guide 71 is V-shaped, i.e., non-linear. However, the shape of the conveyance path of the sheet S is not limited to the V shape, and may be an arc shape (including a curved shape). The movable sheet guide 8 is arranged on the interior angle side of the V shape or the inner periphery side of the arc shape. There may be a plurality of V-shaped portions or arc-shaped portions.

As shown in FIG. 4(*b*), the movable sheet guide 8 at the home position is arranged in such a manner that an imaginary line L2 connecting the center of the discharge port 2 with a position where the drive roller 62 and the driven roller 63 sandwich the sheet S passes through a cross-sectional area of the movable sheet guide 8. An imaginary line L3 connecting, for example, an upper edge of the discharge port 2 with the position where the drive roller 62 and the driven roller 63 sandwich the sheet S passes through the cross-sectional area of the movable sheet guide 8. An imaginary line L4 connecting, for example, a lower edge of the discharge port 2 with the position where the drive roller 62 and the driven roller 63 sandwich the sheet S passes through the cross-sectional area of the movable sheet guide 8. Of course, all the imaginary lines L2 to L4 do not necessarily satisfy the condition of passing through the cross-sectional area, and, for example, only the imaginary lines L2 and L3 may satisfy the condition of passing through the cross-sectional area or only the imaginary lines L2 and L4 may satisfy the condition of passing through the cross-sectional area. Alternatively, only one of the imaginary lines L2 to L4 may satisfy the condition of passing through the cross-sectional area.

Figure 5:
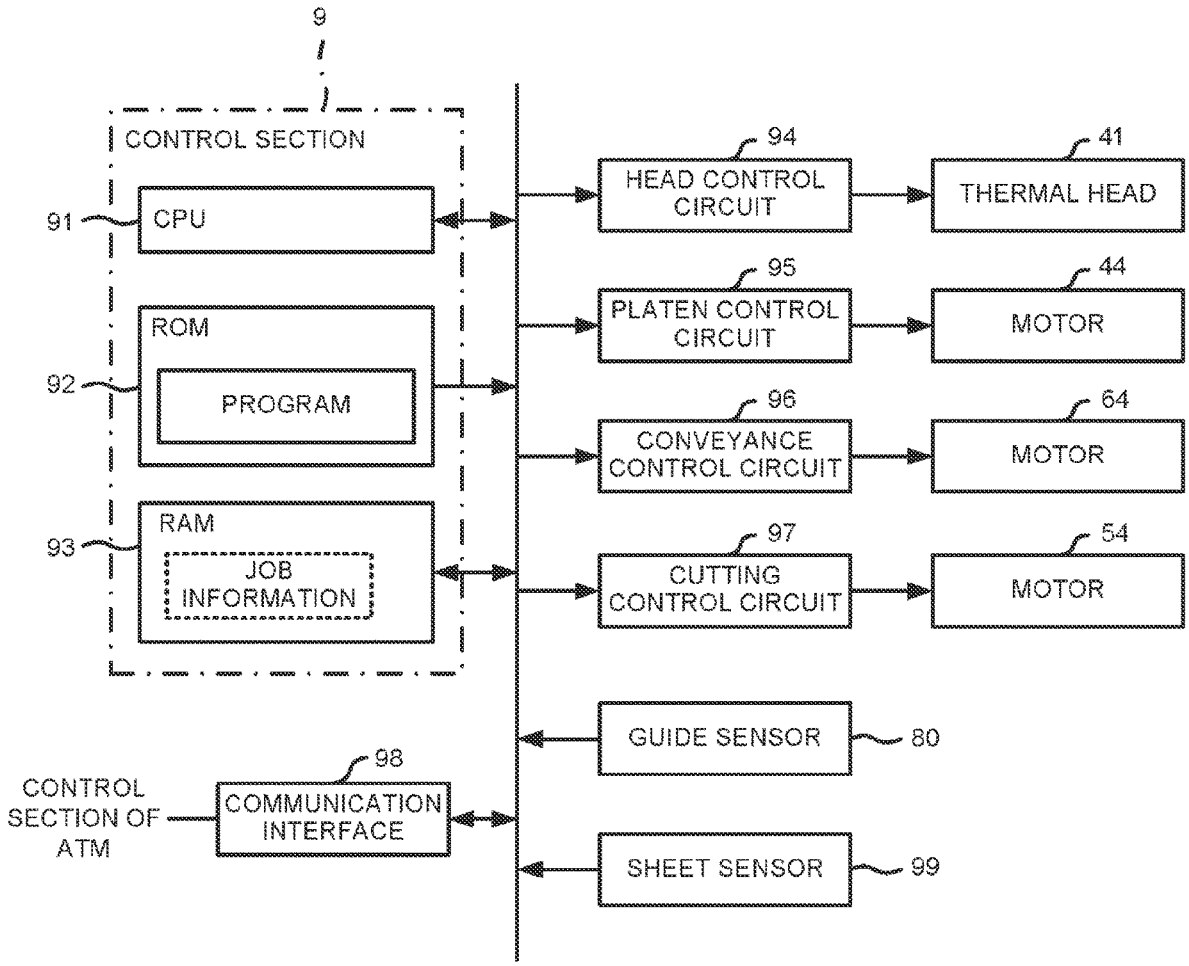
FIG. 5 is a block diagram of the printer according to the embodiment.

Next, a block diagram in FIG. 5 is described. The control section 9 that controls the overall operation of the printer 1 includes a CPU (Central Processing Unit) 91, a ROM (Read Only Memory) 92 and a RAM (Random Access Memory) 93. For example, the CPU 91, the ROM 92 and the RAM 93 are installed on a circuit board, and are provided, for example, in the main body of the printer 1. The control section 9 of the printer 1 and a control section (not shown) for controlling the transaction operation of the ATM may not be provided independently, and the control section for controlling the overall operation of the ATM may also have the function of the control section 9 of the printer 1. The CPU 91 collectively controls the operations of the printer 1 to realize various functions of the printer 1. The ROM 92 stores various programs and data. The RAM 93 temporarily stores various programs and data and can rewrite data. The data temporarily stored in the RAM 93 includes information relating to a printing job received from the control section that controls the transaction operation of the ATM. The RAM 93 is preferably nonvolatile.

A head control circuit 94 controls the printing operation of the thermal head 41. The control section 9 transmits control signals such as arrangement information of dots of an image to be printed, a latch signal, a strobe signal, etc. to the head control circuit 94 based on information relating to the printing job received from the control section that controls the transaction operation of the ATM. A platen control circuit 95 controls operations such as start and stop of the motor 44. The control section 9 transmits a control signal to the platen control circuit 95 so as to rotate the platen roller 42 in synchronization with the printing operation of the thermal head 41. A conveyance control circuit 96 controls operations such as start and stop of the motor 64 for driving the drive roller 62 to rotate. The control section 9 transmits a control signal to the conveyance control circuit 96 so as to rotate the drive roller 62 in synchronization with the rotation of the platen roller 42. A cutting control circuit 97 controls operations such as start and stop of the motor 54. The control section 9 transmits a control signal to the cutting control circuit 97 so as to cut the rear end of the sheet S after the printing is terminated.

The guide sensor 80 detects a position of the movable sheet guide 8 and transmits the detection result to the control section 9. The guide sensor 80 detects whether the movable sheet guide 8 is at the home position or the movable sheet guide 8 has moved upward. The guide sensor 80 is an optical sensor or a contact sensor. Alternatively, the guide sensor 80 may quantitatively detect a position of the movable sheet guide 8 after movement by measuring a movement distance when the movable sheet guide 8 has moved upward.

The communication interface 98 is connected to the control section for controlling the transaction operation of the ATM. The control section 9 of the printer 1 performs communication such as data transmission and reception via the communication interface 98. A sheet sensor 99 detects whether or not there is a sheet S in the vicinity of the printing section (sheet pinching section) formed by the thermal head 41 and the platen roller 42 (not shown in FIG. 1 and FIG. 2). The control section 9 executes the printing operation if the sheet sensor 99 detects the presence of the sheet S, or transmits a signal indicating "the sheet runs out" to the control section for controlling the transaction operation of the ATM without performing the printing operation if no sheet S is detected.

Figure 6:
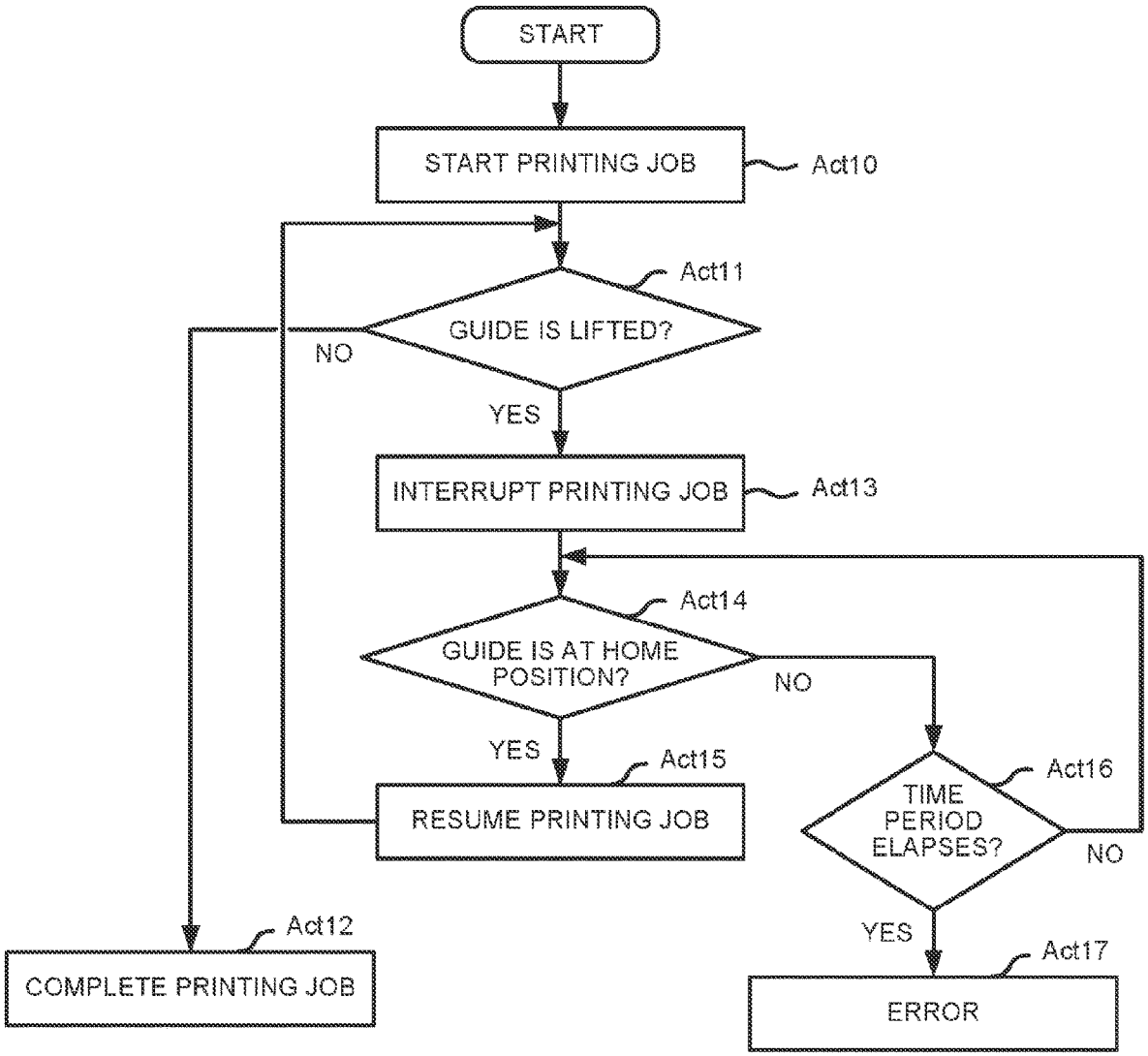
FIG. 6 is a flowchart depicting a processing of detecting a discharge abnormality by the printer according to the embodiment.

Next, with reference to FIG. 6, a flow is described in which the printer 1 detects a discharge abnormality occurring in the sheet S during the execution of the printing job.

If the transaction is completed by an operation performed by the customer, the control section that controls the transaction operation of the ATM generates a printing job for printing a receipt R. The printer 1 receives the information relating to the printing job via the communication interface 98 and transmits the control signals to the control circuits 94 to 97 to start the printing job (Act 10). Specifically, the printer 1 feeds the sheet S to the downstream side while printing an image on the sheet S by cooperation of the thermal head 41 and the platen roller 42. Furthermore, the printer 1 rotates the drive roller 62 of the sheet conveyance section 6 to feed the sheet S towards the discharge section 7. The fed sheet S is sequentially discharged from the discharge port 2. If the printing by the printing section 4 is completed, the printer 1 moves the blade of the movable cutter 53 of the cutting section 5 forward and backward to cut the rear end of the sheet S. Then, the conveyance roller 61 of the sheet conveyance section 6 feeds the rear end of the sheet S towards the discharge port 2. In the case of the partial cutting system, since a part of the rear end of the sheet S is still uncut, the customer pulls out the sheet S (receipt R) by hand to cut out it.

If the movable sheet guide 8 is not moved upward and a series of operations is normally performed (No in Act 11), the printing job is completed (Act 12). However, before the printing is completed, the customer may touch the sheet S (receipt R) by hand in some cases, which causes a discharge abnormality of the sheet S. The discharge abnormality of the sheet S is typically either a discharge abnormality caused by the customer pulling the sheet S (refer to FIG. 7), or a discharge abnormality that the sheet S jams at the inner side of the discharge port 2 (refer to FIG. 8).

Figure 7:
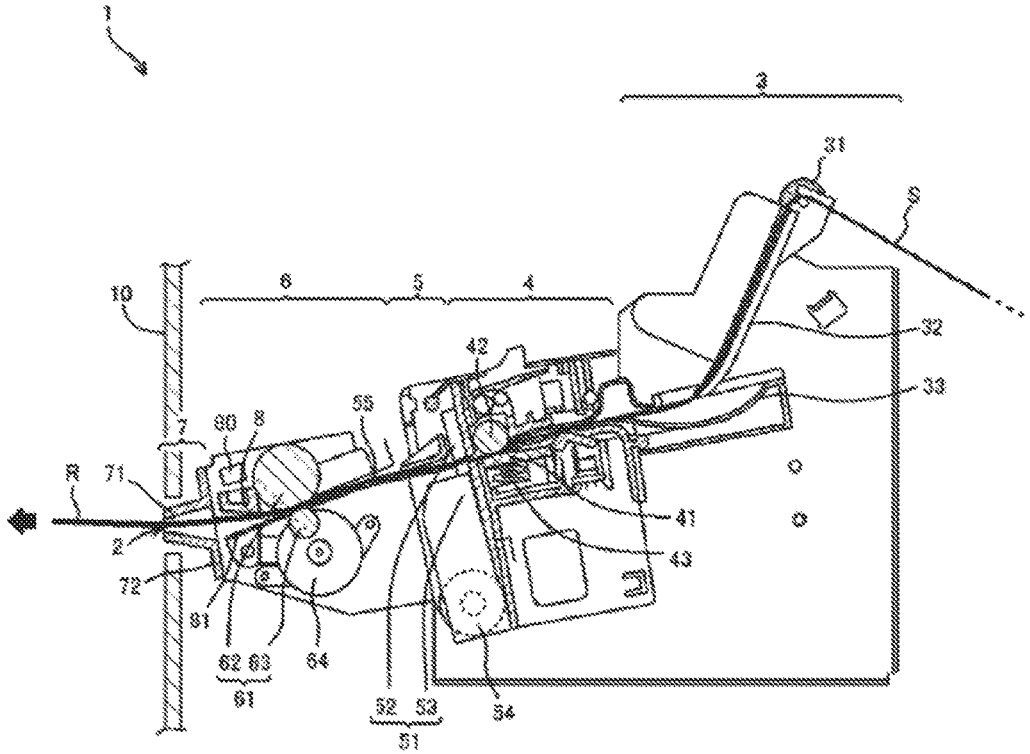
FIG. 7 is a diagram illustrating a state in which the sheet is pulled and a discharge abnormality occurs.
Figure 9:
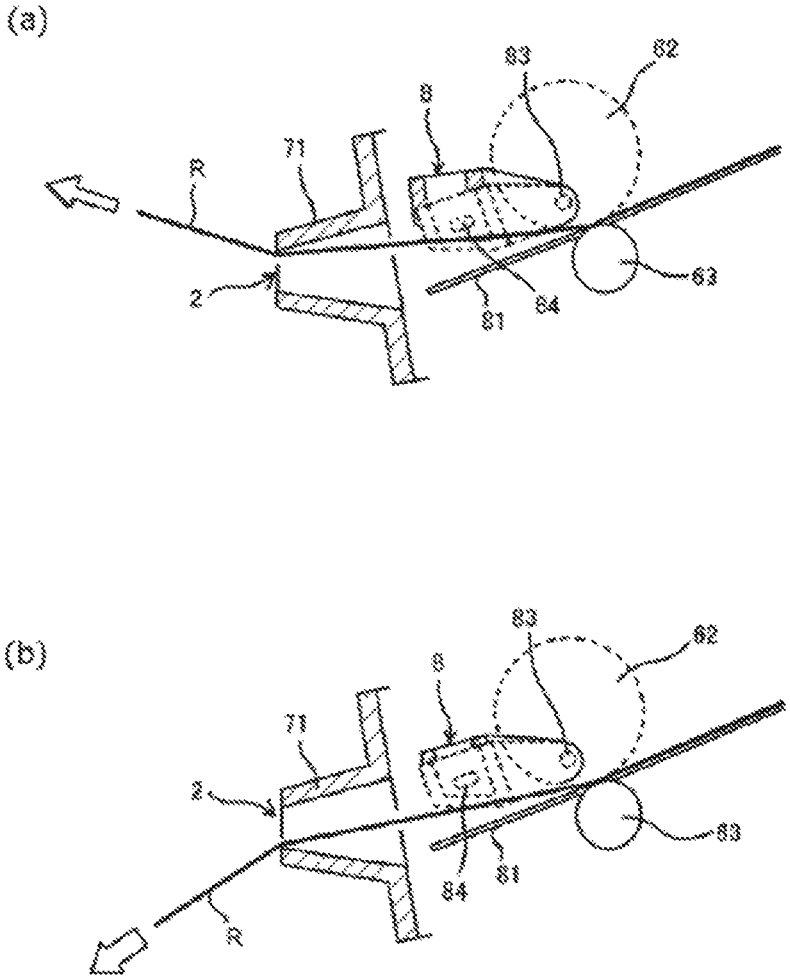
FIG. 9 is a diagram illustrating the movement of the movable sheet guide when the sheet is pulled and a discharge abnormality occurs.

For example, if the customer pulls the sheet S (receipt R) by hand during printing, as shown in FIG. 7 and FIG. 9, the sheet S is pulled with the position where the drive roller 62 and the driven roller 63 sandwich the sheet S as a fulcrum, and the movable sheet guide 8 is lifted (Yes in Act 11). Specifically, the movable sheet guide 8 leaves the home position and moves upward. When the sheet S (receipt R) is pulled in such a manner that the sheet S (receipt R) does not abut against the edge of the discharge port 2 (FIG. 7), when the sheet S (receipt R) is pulled upward in such a manner that the sheet S (receipt R) abuts against the upper edge of the discharge port 2 (FIG. 9(*a*)), or when the sheet S (receipt R) is pulled downward in such a manner that the sheet S (receipt R) abuts against the lower edge of the discharge port 2 (FIG. 9(*b*)), the movable sheet guide 8 is lifted.

The guide sensor 80 detects that the movable sheet guide 8 has moved upward, and transmits the detection result to the control section 9. The control section 9 receives the detection result from the guide sensor 80 and transmits the control signals to the control circuits 94 to 97 to interrupt the execution of the printing job (Act 13).

Here, when the customer releases the sheet S or reduces a pulling force, the state in which the movable sheet guide 8 is lifted is released, and the sheet S and the movable sheet guide 8 are lowered, for example, by their own weight. The movable sheet guide 8 is stopped at the home position by the stopper 84. The guide sensor 80 detects that the movable sheet guide 8 has returned to the home position (Yes in Act 14), and transmits the detection result to the control section 9. The control section 9 receives the detection result from the guide sensor 80 and transmits the control signals to the control circuits 94 to 97 to restart the printing job (Act 15).

If the customer does not release the sheet S or does not reduce the pulling force, the control section 9 transmits an error signal to the control section that controls the transaction operation of the ATM (Act 17), for example, if a set time period elapses (Yes in Act 16). The control section that controls the transaction operation of the ATM informs the customer by, for example, displaying "receipt issuance error" on an operation screen. At the same time, it is preferable to notify the store clerk of the occurrence of the receipt issuance error. The set time period is set, for example, in a range of 5 to 15 seconds. Of course, the set time period is not limited.

Figure 8:
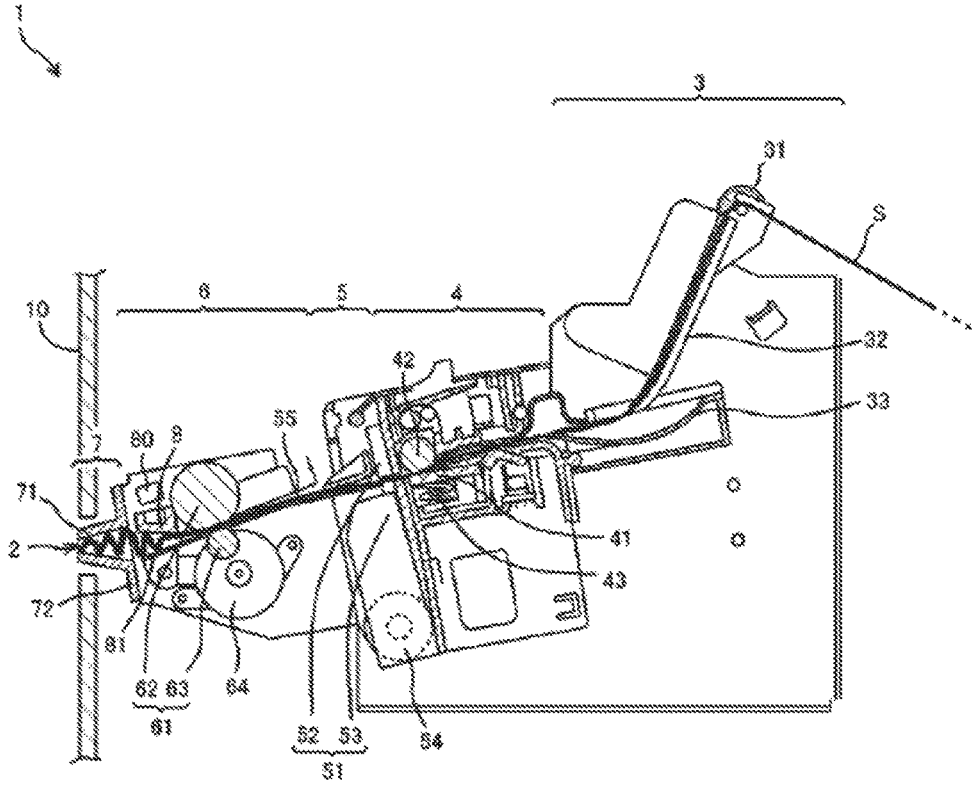
FIG. 8 is a diagram illustrating a state in which a discharge abnormality such as a sheet jam occurs.

As another case, after the printing job is started (Act 10), for example, if the customer touches the sheet S by hand, which interferes with the discharge of the sheet S from the discharge port 2, as schematically shown in FIG. 8, the movable sheet guide 8 is lifted by the sheet S jamming at the inner side of the discharge port 2 (Yes in Act 11). The guide sensor 80 detects that the movable sheet guide 8 has moved upward, and transmits the detection result to the control section 9. The control section 9 receives the detection result from the guide sensor 80 and transmits the control signal to the control circuits 94 to 97 to interrupt the execution of the printing job (Act 13).

As described above, when the sheet S is pulled by hand, the printing job can be resumed if the customer releases the sheet S and the movable sheet guide 8 returns to the home position. However, if the sheet S jams at the inner side of the discharge port 2, the movable sheet guide 8 hardly returns to the home position. Therefore, after that, the set time period elapses (Yes in Act 16), and the error signal is transmitted to the control section that controls the transaction operation of the ATM (Act 17). The jam of the sheet S at the inner side of the discharge port 2 may occur due to factors other than the touch on the sheet S by the hand of the customer.

According to the above-described embodiment, the movable sheet guide 8 is provided between the conveyance roller 61 and the discharge port 2 and it is detected that the movable sheet guide 8 has left the home position and moved upward. With such a configuration, it is possible to detect the discharge abnormality caused by the customer pulling the sheet S which is the print medium by hand and the discharge abnormality that the sheet S jams at the inner side of the discharge port 2. As a result, it is possible to create the receipt R while minimizing the consumption of the sheet S. In particular, the printing job is resumed when the movable sheet guide 8 returns to the home position, thereby improving the effect.

Figure 10:
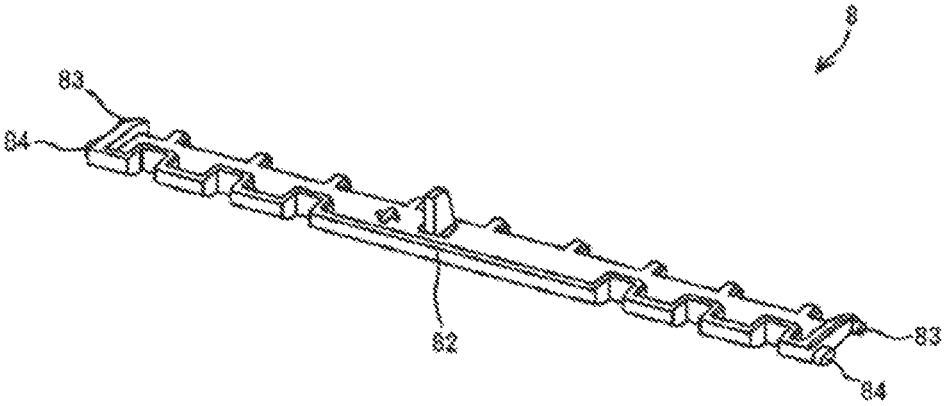
FIG. 10 is a diagram illustrating a modification of the movable sheet guide of the printer according to the embodiment.

The movable sheet guide 8 may have a shape as shown in FIG. 10 as an example of a modification. Of course, the shape of the movable sheet guide 8 is not limited to the shapes shown in FIG. 3 and FIG. 10.

Figure 11:
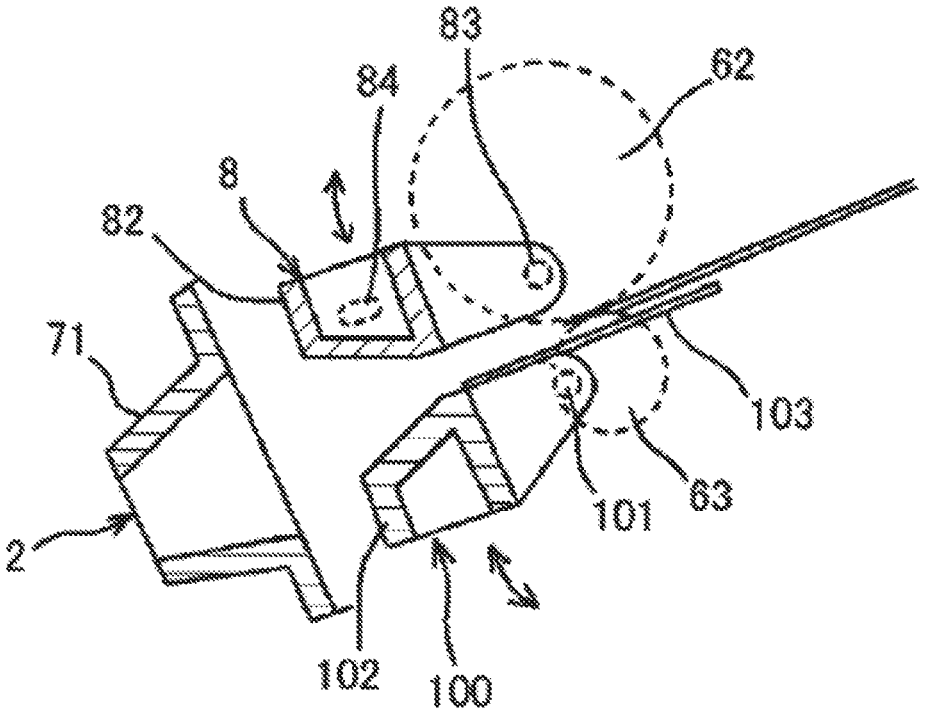
FIG. 11 is a diagram illustrating a modification of the movable sheet guide of the printer according to the embodiment.

Furthermore, the movable sheet guide 8 may be arranged not only on the upper surface side of the sheet S but also on the upper and lower sides as shown in FIG. 11. A movable sheet guide 100 arranged on the lower side also has the same shape as the movable sheet guide 8 arranged on the upper side, is rotatable in a circumferential direction around a rotation axis 101, and has a standing wall 102. However, the movable sheet guide 100 is kept at the home position by support by a supporting member 103 having a restoring force such as a leaf spring instead of the stopper 84, for example. As another modification, only the movable sheet guide 100 arranged on the lower side may be used.

The printer 1 is not limited to a thermal printer, but may be another type of printer such as an inkjet printer. Furthermore, although the printer 1 is described as an example of the image forming apparatus, the image forming apparatus is not limited to the printer 1. Of course, it is not limited to ATM.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

an image forming section configured to form an image on a sheet;

a tapered discharge guide;

a sheet discharge port through which the sheet is discharged from an opening of the tapered discharge guide;

a sheet conveyance roller configured to convey the sheet to the sheet discharge port;

a movable sheet guide, arranged in such a manner that a first imaginary line from a position where the sheet conveyance roller contacts the sheet to an upper edge of the sheet discharge port passes through a cross-sectional area of the movable sheet guide, arranged in such a manner that a second imaginary line from a position where the sheet conveyance roller contacts the sheet to a lower edge of the sheet discharge port passes through the cross-sectional area of the movable sheet guide, the movable sheet guide is configured to move in a direction towards and away from a surface of the sheet;

a guide sensor configured to detect movement of the movable sheet guide; and a fixed sheet guide on a lower side relative to the movable sheet guide, wherein a sheet conveyance path from a portion of the sheet conveyance roller contacting the sheet to the sheet discharge port defined by the fixed sheet guide and the tapered discharge guide, and the sheet conveyance path includes a V-shape.

2. The image forming apparatus according to claim 1, wherein the movable sheet guide is arranged on an interior angle side of the V-shape.

3. The image forming apparatus according to claim 1, further comprising:

a control section configured to control operations of the sheet conveyance roller to interrupt conveyance of the sheet when the guide sensor detects that the movable sheet guide is moved in a direction away from the surface of the sheet from a home position, and resumes conveyance of the sheet when the guide sensor detects that the movable sheet guide returns to the home position.

4. The image forming apparatus according to claim 3, wherein the control section transmits an error signal when the movable sheet guide does not return to the home position within a set time period.

5. The image forming apparatus according to claim 3, wherein the movable sheet guide has a width larger than a width of the sheet.

6. The image forming apparatus according to claim 3, wherein the movable sheet guide is positioned between the sheet conveyance roller and the sheet discharge port.

7. The image forming apparatus according to claim 3, wherein the movable sheet guide is configured to contact the sheet between the sheet conveyance roller and the sheet discharge port.

8. An automated teller machine, comprising:

monetary transaction components; and an image forming apparatus configured to provide a receipt of monetary transactions, comprising:

an image forming section configured to form an image on a sheet;

a tapered discharge guide;

a sheet discharge port through which the sheet is discharged from an opening of the tapered discharge guide;

a sheet conveyance roller configured to convey the sheet to the sheet discharge port;

a movable sheet guide, arranged in such a manner that a first imaginary line from a position where the sheet conveyance roller contacts the sheet to an upper edge of the sheet discharge port passes through a cross-sectional area of the movable sheet guide, arranged in such a manner that a second imaginary line from a position where the sheet conveyance roller contacts the sheet to a lower edge of the sheet discharge port passes through the cross-sectional area of the movable sheet guide, the movable sheet guide is configured to move in a direction towards and away from a surface of the sheet;

a guide sensor configured to detect movement of the movable sheet guide; and a fixed sheet guide arranged on a lower side relative to the movable sheet guide, wherein a sheet conveyance path from a portion of the sheet conveyance roller contacting the sheet to the sheet discharge port defined by the fixed sheet guide and the tapered discharge guide, and the sheet conveyance path includes a V-shape.

9. The automated teller machine according to claim 8, wherein the movable sheet guide is arranged on an interior angle side of the V-shape.

10. The automated teller machine according to claim 8, further comprising:

a control section configured to control operations of the sheet conveyance roller to interrupt conveyance of the sheet when the guide sensor detects that the movable sheet guide is moved in a direction away from the surface of the sheet from a home position, and resumes conveyance of the sheet when the guide sensor detects that the movable sheet guide returns to the home position.

11. The automated teller machine according to claim 10, wherein the control section transmits an error signal when the movable sheet guide does not return to the home position within a set time period.

12. The automated teller machine according to claim 8, wherein the movable sheet guide has a width larger than a width of the sheet.

13. The automated teller machine according to claim 8, wherein the movable sheet guide is positioned between the sheet conveyance roller and the sheet discharge port.

14. The automated teller machine according to claim 8, wherein the movable sheet guide is configured to contact the sheet between the sheet conveyance roller and the sheet discharge port.

15. An image processing method, comprising:

forming an image on a sheet;

conveying the sheet to a sheet discharge port through which the sheet is discharged from an opening of a tapered discharge guide;

moving a movable sheet guide in a direction at least one of towards and away from a surface of the sheet, wherein the movable sheet guide is arranged such that a first imaginary line from a position where a sheet conveyance roller contacts the sheet to an upper edge of the sheet discharge port passes through a cross-sectional area of the movable sheet guide, arranged such that a second imaginary line from a position where the sheet conveyance roller contacts the sheet to a lower edge of the sheet discharge port passes through the cross-sectional area of the movable sheet guide; and detecting movement of the movable sheet guide, wherein a sheet conveyance path from a portion of the sheet conveyance roller contacting the sheet to the sheet discharge port defined by a fixed sheet guide and the tapered discharge guide, and the sheet conveyance path includes a V-shape.

16. The image processing method according to claim 15, further comprising:

interrupting conveying the sheet when detecting movement of the movable sheet guide in a direction away from the surface of the sheet from a home position, and resuming conveying the sheet when detecting that the movable sheet guide returns to the home position.

17. The image processing method according to claim 16, further comprising:

transmitting an error signal when the movable sheet guide does not return to the home position within a set time period.

18. The image processing method according to claim 15, further comprising:

contacting the sheet with the movable sheet guide when the sheet is between the sheet conveyance roller and the sheet discharge port.

* * * * *